US006033346A

United States Patent [19]

Wang et al.

[11] Patent Number: 6,033,346

[45] Date of Patent: Mar. 7, 2000

[54] ADJUSTMENT MECHANISM FOR THE REAR SUPPORTING BEAM OF A TREADMILL

[75] Inventors: Leao Wang, Taichung; Peter Wu, Taiping, both of Taiwan

[73] Assignee: Greenmaster Industrial Corp., Taiping, Taiwan

[21] Appl. No.: 09/037,341

[22] Filed: Mar. 10, 1998

[51] Int. Cl.[7] ..... A63B 22/02

[52] U.S. Cl. ..... 482/54

[58] Field of Search ..... 482/51, 52, 54

[56] References Cited

U.S. PATENT DOCUMENTS

| | | | |
|---|---|---|---|
| 3,643,943 | 2/1972 | Erwin et al. | 482/54 |
| 4,643,418 | 3/1987 | Bart | 482/54 |
| 5,085,426 | 2/1992 | Wanzer et al. | 482/54 |
| 5,163,885 | 11/1992 | Wanzer et al. | 482/54 |
| 5,382,207 | 1/1995 | Skowronski et al. | 482/54 |
| 5,733,228 | 3/1998 | Stevens | 482/54 |

*Primary Examiner*—Glenn E. Richman
*Attorney, Agent, or Firm*—Dougherty & Troxell

[57] ABSTRACT

The invention relates to an improved adjustment mechanism to the anchoring angle of the rear supporting beam in a treadmill. It has two positioning plates along the two sides near the bottom of a treadmill frame. That bottom surface near the outer edge is equipped with a stop piece. The rear supporting beam is then attached via the holes on the extended parts to the positioning plates. Two connecting pieces are used to mount a coupling over a through axle, placed between two corresponding holes on the two extensions from the rear supporting beam. The two connecting pieces are connected to a threaded bar and the other end of the threaded bar is put through a punched hole on the supporting beam. A turn knob is threaded over the bar exposed outside the supporting beam to complete the assembly. By turning the turn knob on the threaded beam, it could be used to shift the rear beam's anchoring angle can be adjusted to further achieve the fine-tuning of the slanting angle of a treadmill frame.

6 Claims, 4 Drawing Sheets

ADJUSTMENT MECHANISM FOR THE REAR SUPPORTING BEAM OF A TREADMILL

BACKGROUND OF THE INVENTION

1. Field of the Invention

The present invention relates generally to the adjustment mechanism that regulates the anchoring angle of the rear supporting beam of a treadmill, and more particularly to an anchoring angle of a rear support beam that can be fine-tuned in order to provide flexible slanting angles to the treadmill frame.

2. Description of the Prior Art

FIG. 1 shows a prior art disclosed in U.S. Pat. No. 5,607,375, which is currently the most widely used adjustment mechanism for the anchoring angle on the rear supporting beam of a treadmill. The drawings reveal that it primarily concerns placing a brake piece 11 atop the rear supporting beam 10 thereof, the opposite side from the brake piece 11 is equipped with several incremental slanted stop notches 12. The mechanism of a connecting axle 13 is connected to supporting board 15 located at the bottom surface of the treadmill frame 14. Thereafter, the lower side of the supporting board 15 is equipped with a stop piece 17 via a transmission axle 16, while the axial beam 18 beneath that stop piece 17 is equipped with a hooked spring 20 to the corresponding axial beam 19 on the supporting board 15. At this time, the top part 171 of the stop piece 17 will engage with any slanted notch 12 on the brake piece 11 and remain in a stationary position. Therefore, when the slant angle of the treadmill frame 14 has to be adjusted, it only requires one to lift the treadmill frame 14, while the weight of the rear supporting beam 10 will automatically rotate around the connecting axle 13 to drop downward. Right now, the position of slanted notch 12 on the other side of the brake piece 11 will follow to shift upwardly so that the top part 171 of the stop piece 17 falls on the next slanted notch 12 to modify the anchoring angle of the rear supporting beam, and to further modify the slant angle of the treadmill frame 14.

However, although this structural design is deemed as convenient, in actual application the position of the slanted notches 12 on the brake piece 11 and the number of increments are fixed, thus its anchoring angle's changes are extremely limited, and may not meet the user's demands.

SUMMARY OF THE INVENTION

The present invention relates to a supporting angle within a permissible range that enables the user to flexibly adjust the supporting angle of the rear supporting beam, but it is not limited to certain designated angles so that it may fully support the user's demands.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
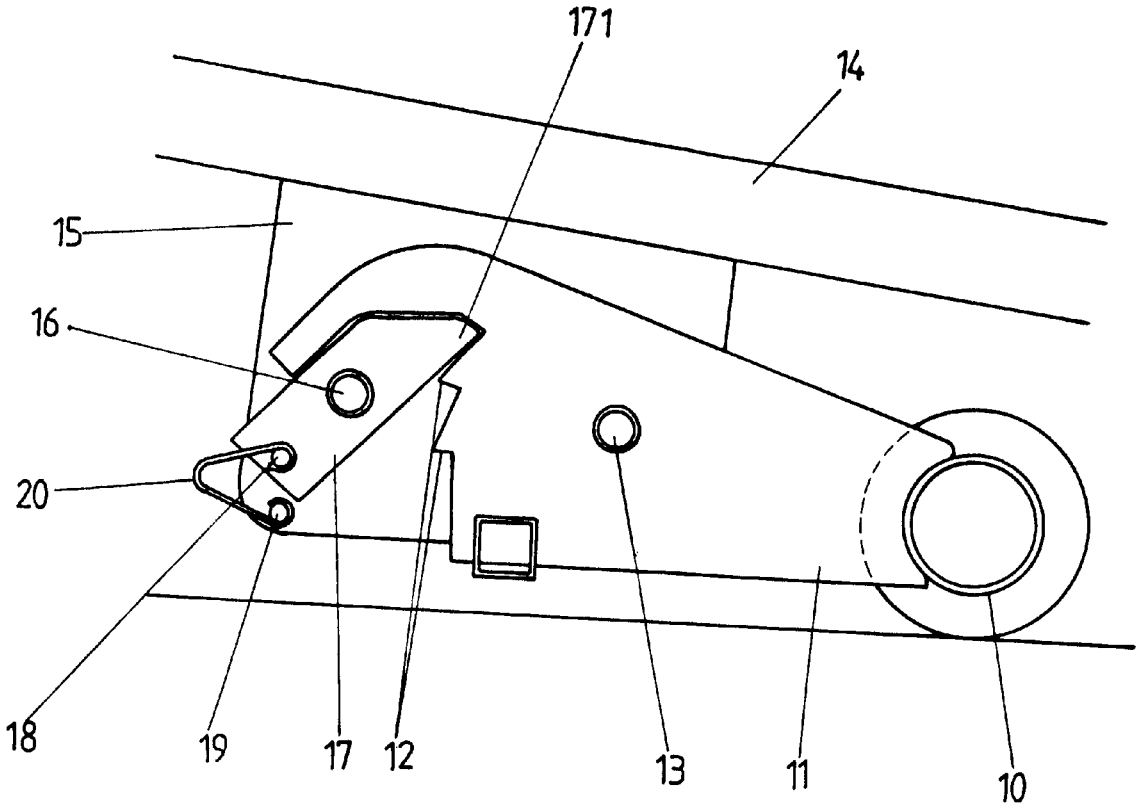
FIG.1 PRIOR ART
FIG. 1 is a schematic view of a prior art disclosed in U.S. Pat. No. 5,607,375.
Figure 2:
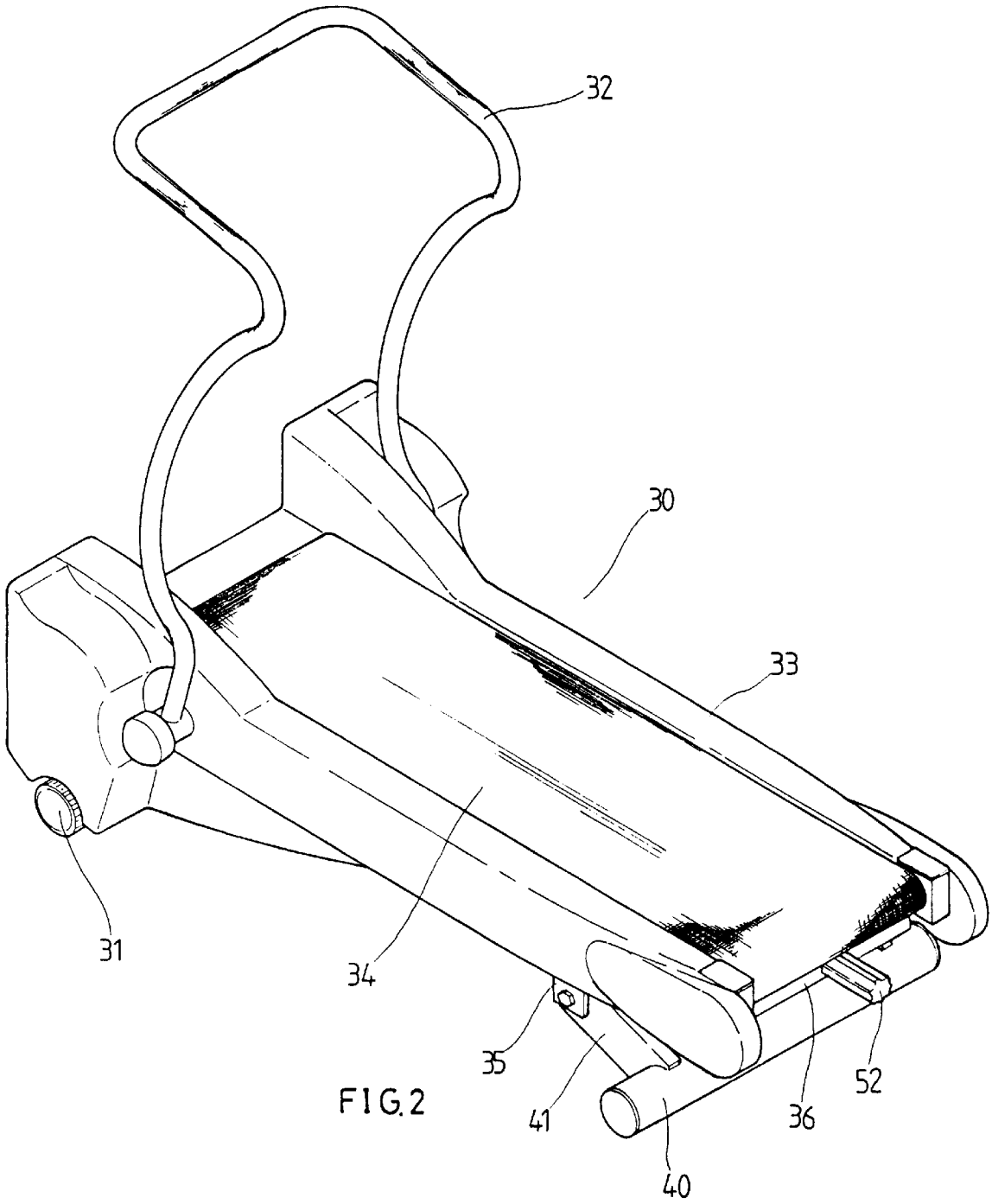
FIG. 2 is an assembled perspective view of the preferred embodiment of the present invention.
Figure 3:
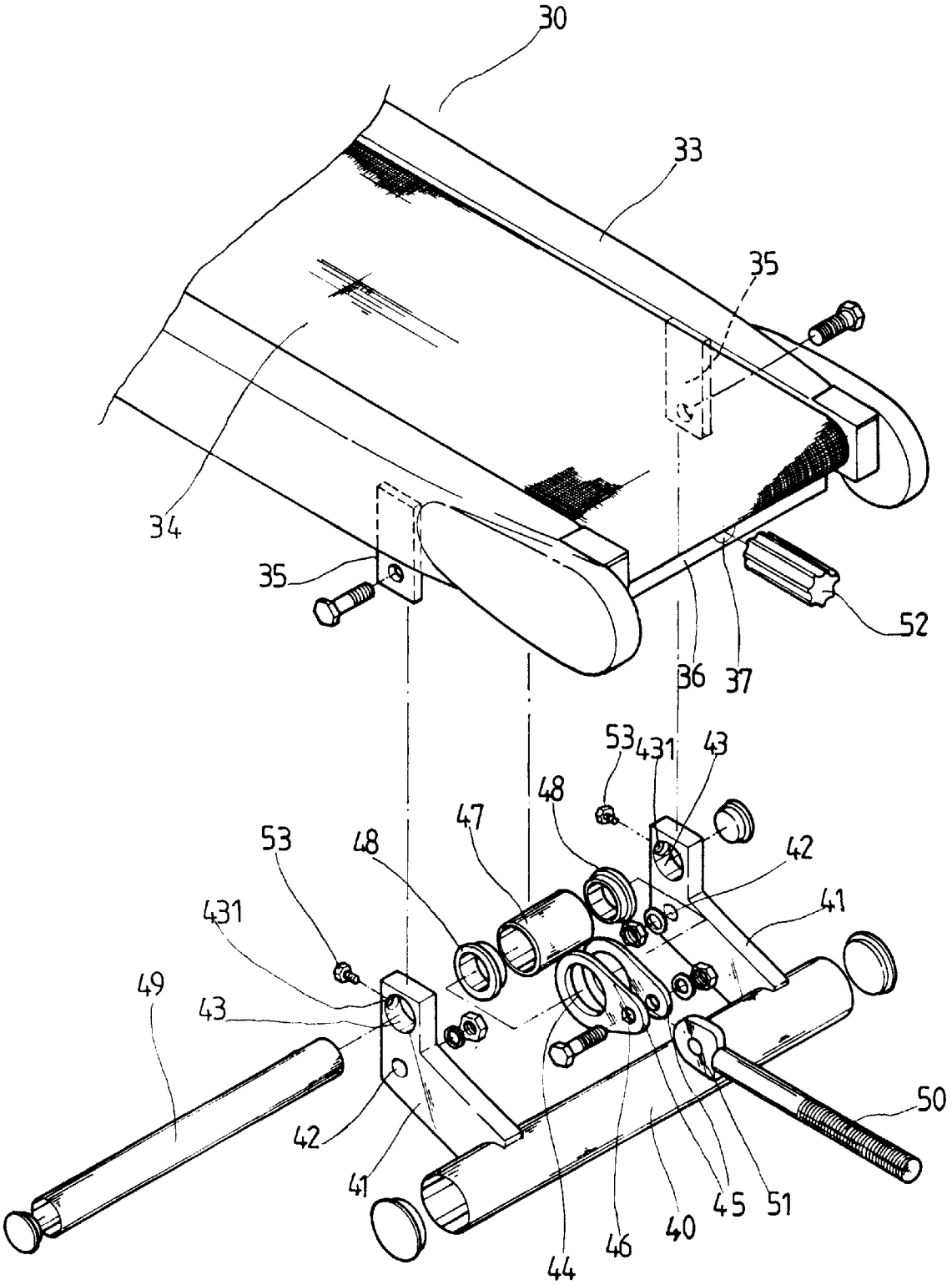
FIG. 3 is an exploded, perspective view of the preferred embodiment of the present invention.

With reference to FIGS. 2 and 3, the adjustment mechanism for the rear supporting beam's anchoring angle described in the present invention is installed at the bottom surface on the rear side from the hand rail of all general treadmills. The treadmill 30 comprises a front supporting beam 31, a hand rail 32, a treadmill frame 33, a running strip 34, and a rear supporting beam 40 as the basic components. The two sides on the bottom near the outer edge near the rear of the treadmill frame 33 are equipped with two positioning plates 35. The bottom surface near the edges is equipped with a supporting bar 36, while the rear supporting beam 40 is fastened via the two holes 42 on the matching extended pieces 41 with two sets of bolts and nuts to connect to the positioning plates 35 on the treadmill frame 33 to complete the assembly.

The invention utilizes the two connecting pieces 45 containing punched hole 44 to connect with a coupling 47, then the mechanism of two positioning caps 48 are used to anchor the coupling 47 onto a through axle 49, while the through axle 49 is placed between the corresponding through holes 43 on the two extended pieces 41 of the rear supporting beam 40. Thereafter, between the corresponding through holes 46 on the two connecting pieces 45 is inserted the flat part 51 of the threaded beam 50 and fastened with another bolt and nut, while the other side of the threaded beam 50 is put through a punched hole 37 on the supporting beam 36 of the treadmill frame 33. The assembly is completed by fastening a turn knob 52 over the beam 50 exposed outside the support beam 36.

The aforementioned locking devices are respectively include threaded bolts, gaskets, and nuts in order to constitute a locking unit. As for the two sides of the rear supporting beam 40 and the through axle 49, there are separately equipped with axial protectors.

To prevent the through axle 49 from slipping out of the through holes 43 on the extended pieces 41 a threaded hole 431 extends through pieces 41 to facilitate insertion of a screw 53 to hold the through axle 49 in place.

Figure 4:
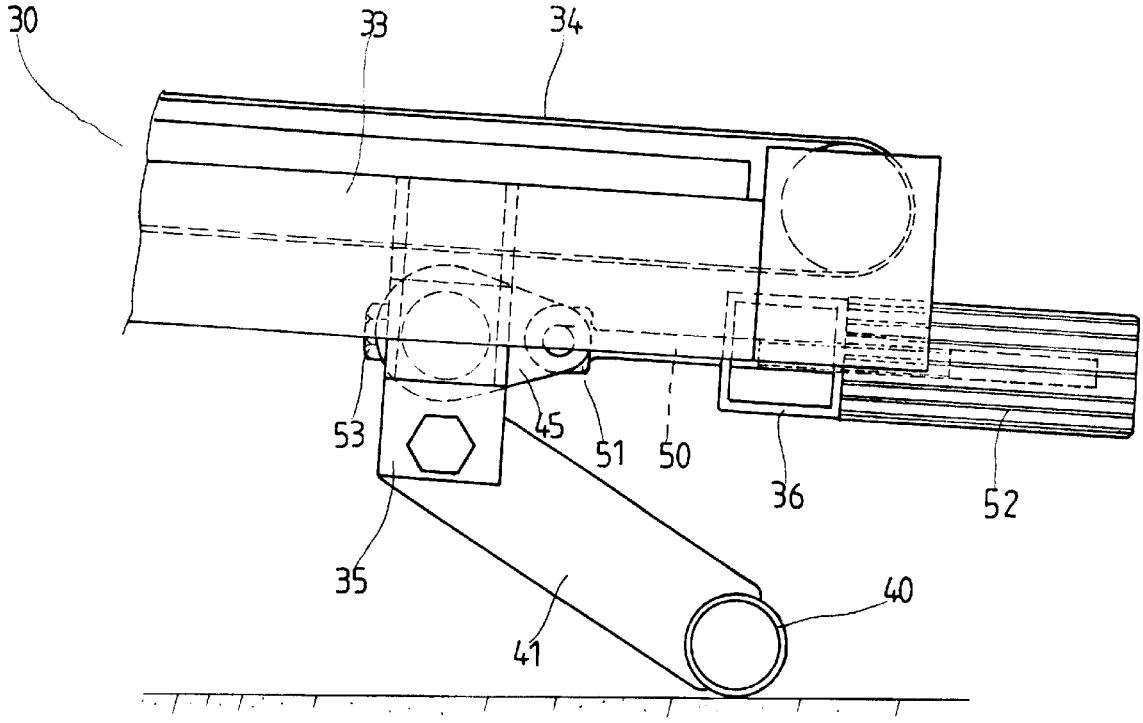
FIG. 4 is a side view of the preferred embodiment of the present invention.
Figure 5:
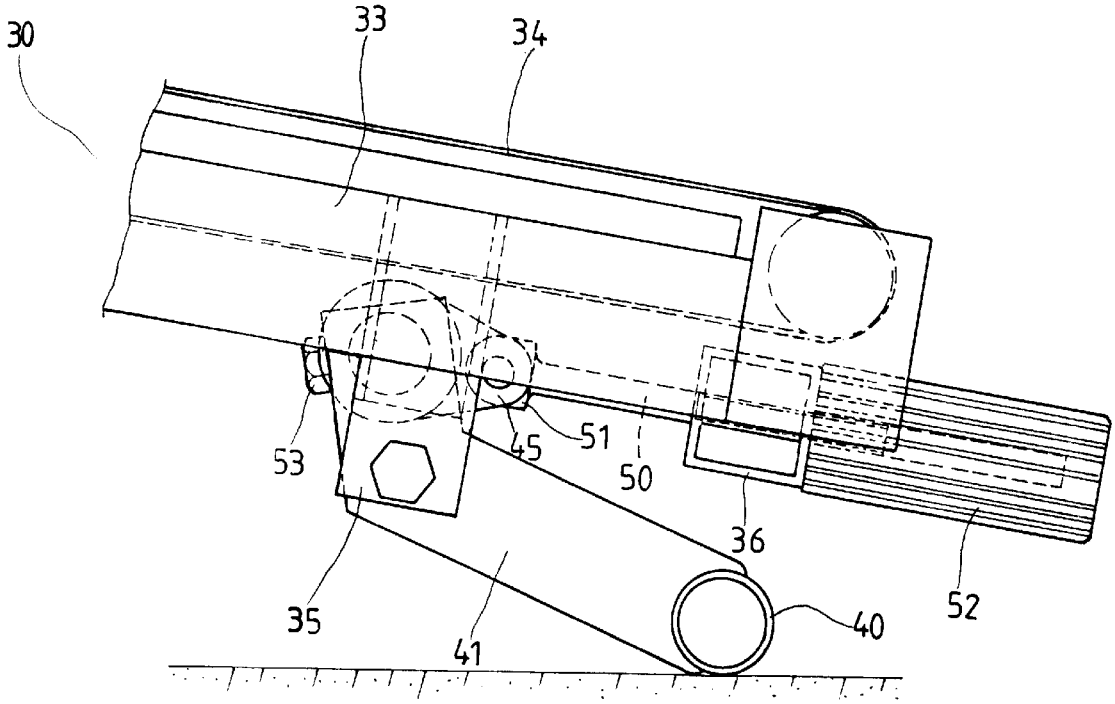
FIG. 5 is another side view of the preferred embodiment of the present invention.

When the aforementioned mechanism has been assembled, the turn knob 52 will be pushed against the corresponding surface of the supporting beam 36 of the treadmill frame 33, which is caused by the weight of the treadmill frame 33 that generates constant pressure against the rear supporting beam 40. Therefore, with reference to FIGS. 3 and 4, when the turn knob 52 is rotated, because the position of turn knob 52 remains unchanged, thus the threaded bar 50 will shift due to the mechanism of the threading to either pull or release the connecting piece 45. However, as mentioned earlier, the connecting piece 45, the coupling 47, and the through axle 49 are in a lateral relation, while the shifting of the through axle 49 will move the extended parts 41 of the rear supporting beam 40, thus the rear supporting beam 40 will rotate around the connecting holes 42 for synchronized rotation. As a result, the rotation on the extended parts 41 of the rear supporting beam 40 can be used to change the rear support beam's 40 anchoring angle to achieve a fine-tuning of the slanting angle of the treadmill frame 33.

Although the present invention has been illustrated and described with reference to the preferred embodiment thereof, it should be understood that it is in no way limited to the details of such embodiment but is capable of numerous modifications within the scope of the appended claims.

What is claimed is:

1. An adjustment mechanism for adjusting the position of a rear supporting beam of a treadmill having a treadmill frame with a movable running strip thereon, to adjust the angle of the treadmill frame, the adjustment mechanism comprising:

a) at least one extended piece extending from the rear supporting beam and pivotally connected to a rear portion of the treadmill frame so as to pivot about a pivot axis extending transversely to the treadmill frame;

b) a through axle connected to the at least one extended piece and spaced from the pivot axis;

c) a threaded beam member extending through a supporting bar of the treadmill frame located at the rear portion of the treadmill frame, the threaded beam member having a threaded first end portion and a second end;

d) at least one connecting piece connected to the second end of the threaded beam and mounted on the through axle so as to prevent rotation of the threaded beam about a longitudinal axes; and e) a knob threadingly attached to the threaded first end portion of the threaded beam, the knob bearing against the supporting bar such that rotation of the knob causes movement of the threaded beam along the longitudinal axis, such movement causing the at least one extended piece to pivot about the pivot axis, thereby changing the position of the rear supporting beam relative to the rear portion of the treadmill frame.

2. The adjustment mechanism of claim 1, wherein the at least one connecting piece comprises a pair of connecting pieces located on opposite sides of the second end of the threaded beam.

3. The adjustment mechanism of claim 2, further comprising a coupling tube mounted on the through axle and extending through an opening in each of the pair of connecting pieces.

4. The adjustment mechanism of claim 3, wherein the coupling tube has opposite ends and further comprising a positioning end cap mounted in each opposite end.

5. The adjustment mechanism of claim 1, wherein the through axle extends substantially transversely across the treadmill frame.

6. The adjustment mechanism of claim 5, wherein the threaded beam is oriented substantially perpendicular to the through axle.

* * * * *